United States Patent [19]

David

[11] Patent Number: 4,982,960

[45] Date of Patent: Jan. 8, 1991

[54] TWO-HANDLE BATON

[76] Inventor: Robert David, 6769 Vickiview Dr., Westhills, Calif. 91307

[21] Appl. No.: 316,097

[22] Filed: Feb. 27, 1989

[51] Int. Cl.[5] ..... F41B 15/02

[52] U.S. Cl. ..... 273/84 R

[58] Field of Search ..... 273/73 J, 75, 81.2, 273/84 R, 80 D; 135/66

[56] References Cited

U.S. PATENT DOCUMENTS 3,335,735 8/1967 Colegrove et al. ..... 273/80 D 4,739,990 4/1988 Aguirre et al. ..... 273/84 R

*Primary Examiner*—Edward M. Coven

*Assistant Examiner*—W. Pierce

*Attorney, Agent, or Firm*—Poms, Smith, Lande & Rose

[57] ABSTRACT

A two-handed baton is shown constructed from a hollow cylindrical shaft having a first fixed handle at one end extending at an angle from one side of the cylindrical shaft and a second handle normally placed close to the first handle on the same side as the first handle and parallel thereto. The second handle is spring loaded to slide from its normal position at one end of the cylindrical shaft next to the first handle toward the opposite end of the cylindrical shaft.

8 Claims, 4 Drawing Sheets

20
80
48
46
14
44
12
76
78
62
52
54
42

48
14
52
54
38
18
10
40
12
26
35
32
30
33
34
28
31
36
24

48
14
60
56
12
54
40
18
35

26
33
34
35
32
30
24
28
31
36
58
60
14
66
18
64
12
70
72
62
68
74
56

TWO-HANDLE BATON

FIELD OF THE INVENTION

The present invention relates to a baton or night stick used for self-defense or by police and, more particularly, to a two-handle baton.

BACKGROUND OF THE INVENTION

Police batons or night sticks have been known for over a hundred years. The early batons included a single cylindrical shaft which might have a handle grip at one end. These early night sticks might also be improved by the use of a lanyard or strap near the handle which could be worn around the wrist of the user.

Early inventors conceived idea of placing a plurality of devices within a single police baton. One such invention, by H. C. Reichard, U.S. Pat. No. 116,097, issued June 20, 1871, shows a police baton which incorporates a rattle and a pair of manacles within the single baton. Another device that shows a plurality of weapons was invented by a British subject, J. E. Peskett, U.K. Pat. No. 559,747, issued March 3, 1944. This patent shows a blade and blackjack-like weapon on either end of a baton.

The baton was further improved in later years by the addition of a handle located at one end thereof which extend at right angles thereto to permit the user to obtain a better grip upon the baton. The handle extending from the baton permitted additional maneuvers, such as spins and strikes. However, one problem with the spin maneuver was that the user was never certain where the baton would be at any particular moment through the 360 degrees of spin.

An example of a multi-handled baton is shown in a patent by M. Wong, U.S. Pat. No. 4,052,063, issued Oct. 4, 1977. This device seems to be designed more for throwing and does not incorporate many of the desirable features of the older, well-known police baton.

Examples of improved police batons utilizing a single handle mounted toward one end thereof and at right angles thereto may be found in a patent by J. H. Zentmyer, U.S. Pat. No. 4,109,912, issued Aug. 29, 1978; and in a patent by D. A. Raitto, U.S. Pat. No. 4,667,958, issued May 26, 1987.

There have been additional efforts to improve the police baton with the addition of an auxiliary handle that extends from the first handle which, in turn, extends from the main shaft of the baton. Such a device is shown in a patent by T. Kubota, U.S. Pat. No. 4,703,932, issued Nov. 3, 1987.

One problem with the newer batons having handles at a right angle to one end thereof is found when the user grasps the end of the baton opposite the right angled handle to hook the leg of an attacker, for example. When the smooth surface of the baton is being used, the attacker can grab the handled end of the baton and, due to the mechanical advantage created by the handle, disarm the individual defending himself with the baton.

SUMMARY OF THE INVENTION

Accordingly, it is an object of the present invention to provide an improved baton which may be used by police officers or for self-defense Another object of the present invention is to provide an improved baton having the additional safety feature of two handles which permits the user to grasp one handle while swinging the baton or hooking a potential attacher.

Yet another object of the present invention provides a baton that may be used for self-protection having the quality of an expensive fire arm and capabilities not previously found in police batons, night sticks, billy clubs, or tonfas.

In accomplishing these objects there is provided a cylindrical shaft which forms the baton. Extending from the cylindrical shaft on one side thereof is a first cylindrical handle which is arranged at an angle to the shaft. A second handle extends from the shaft on the same side as the first handle and at the same angle to the shaft. The two handles are also parallel to each other. In a further embodiment, the handles are normally located so that the second handle forms a guard to the first handle The second handle is slidably mounted within the cylindrical baton and urged by a spring from its normal position adjacent the first handle at one end of the baton to a second position at the opposite end of the baton. In this configuration, the baton may be used for blocking or other maneuvers.

DESCRIPTION OF THE DRAWINGS

A better understanding of the present invention will be had after consideration of the specification and accompanying drawings, wherein.

DESCRIPTION OF THE PREFERRED EMBODIMENTS

Figure 1:
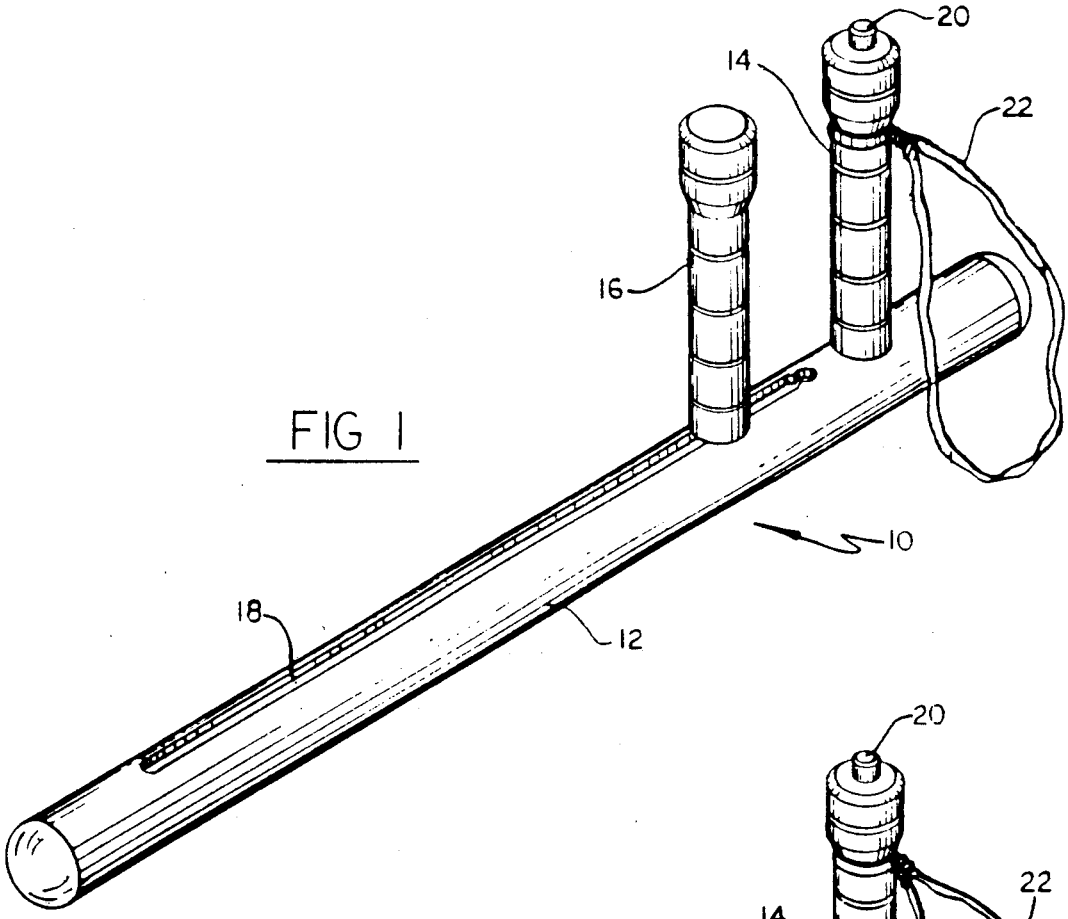
FIG. 1 is a side, perspective view of a two-handle baton of the present invention.
Figure 2:
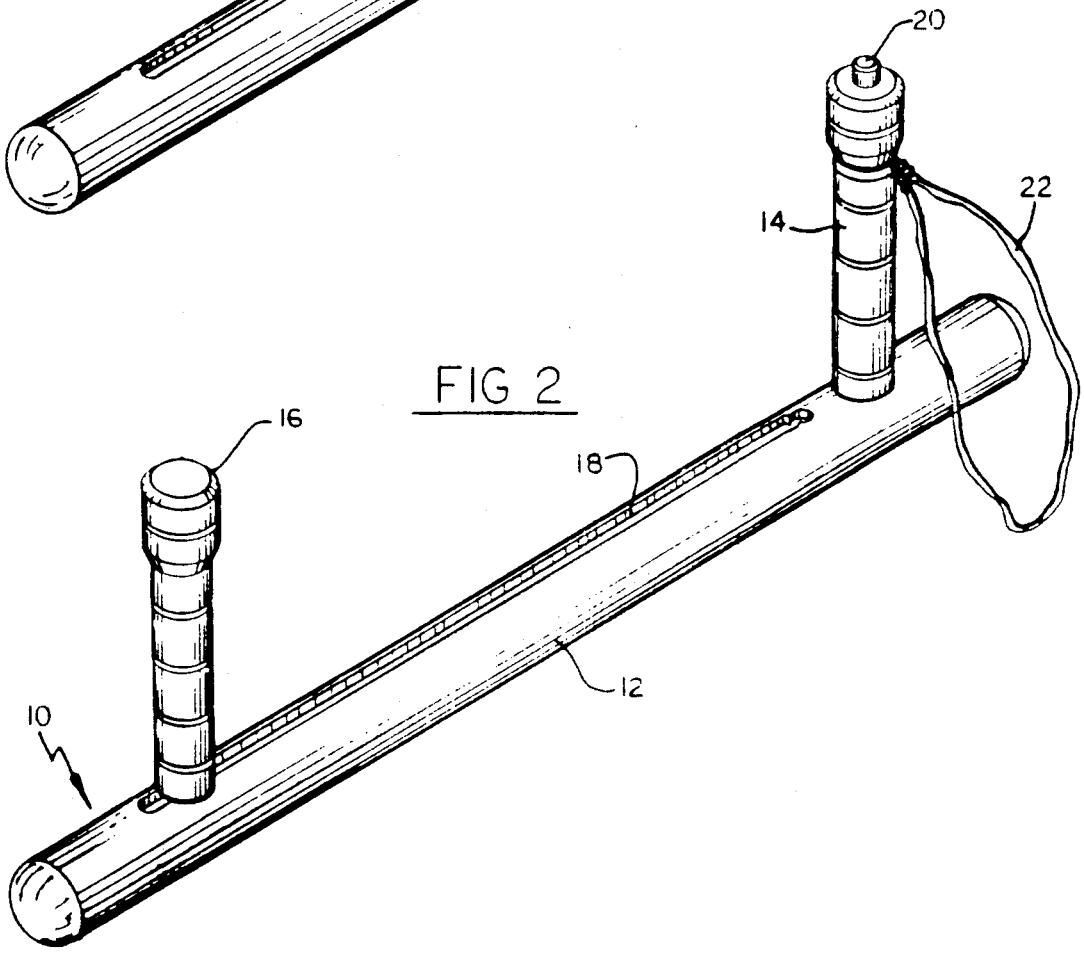
FIG. 2 is a side view, similar to FIG. 1, showing the second handle of the two-handle baton moved from its normal guard position to its open position.

Referring now to the drawings, FIG. 1 shows a two-handle baton 10 formed from a hollow cylindrical shaft 12 having a first handle 14 extending at an angle from one side and one end of shaft 12. In the preferred embodiment, the angle of extension is a right angle. A second handle 16 is normally mounted within a few inches of the first handle 14 and, under normal use, may act as a guard for the first handle. The second handle 16 extends from the same side of the cylindrical shaft 12 as the first handle 12 but, unlike the first handle, is not permanently affixed to the shaft 12. The second handle 16 is slidably mounted within a slot 18 so that depression a spring loaded push button 20 will cause a compressed spring to slide the second handle 16 to the far end of slot 18, as best seen in FIG. 2. A lanyard or strap 22 may be attached to the first handle 14 to complete the two-handle baton 10.

In the preferred embodiment, the shaft 12 of the two-handle baton 10 may have various lengths. By way of example only, a shaft could be constructed 26 inches long. Similarly, the length of the first and second handles 14 and 16 could be 5½ inches with a separation therebetween, in the normal position, of approximately 2½ inches. In the open position, shown in FIG. 2, the first and second handles may be approximately 7½ inches from the end of the baton shaft 12 with a distance therebetween of approximately 11 inches. These dimensions may vary within the teachings of this invention. The shaft 12 and handles 14 and 16 may be made any suitable material such as high strength aluminum, corrosion resistant steel or carbon fiber reinforced plastic.

Figures 3, 4, 5, 5A:
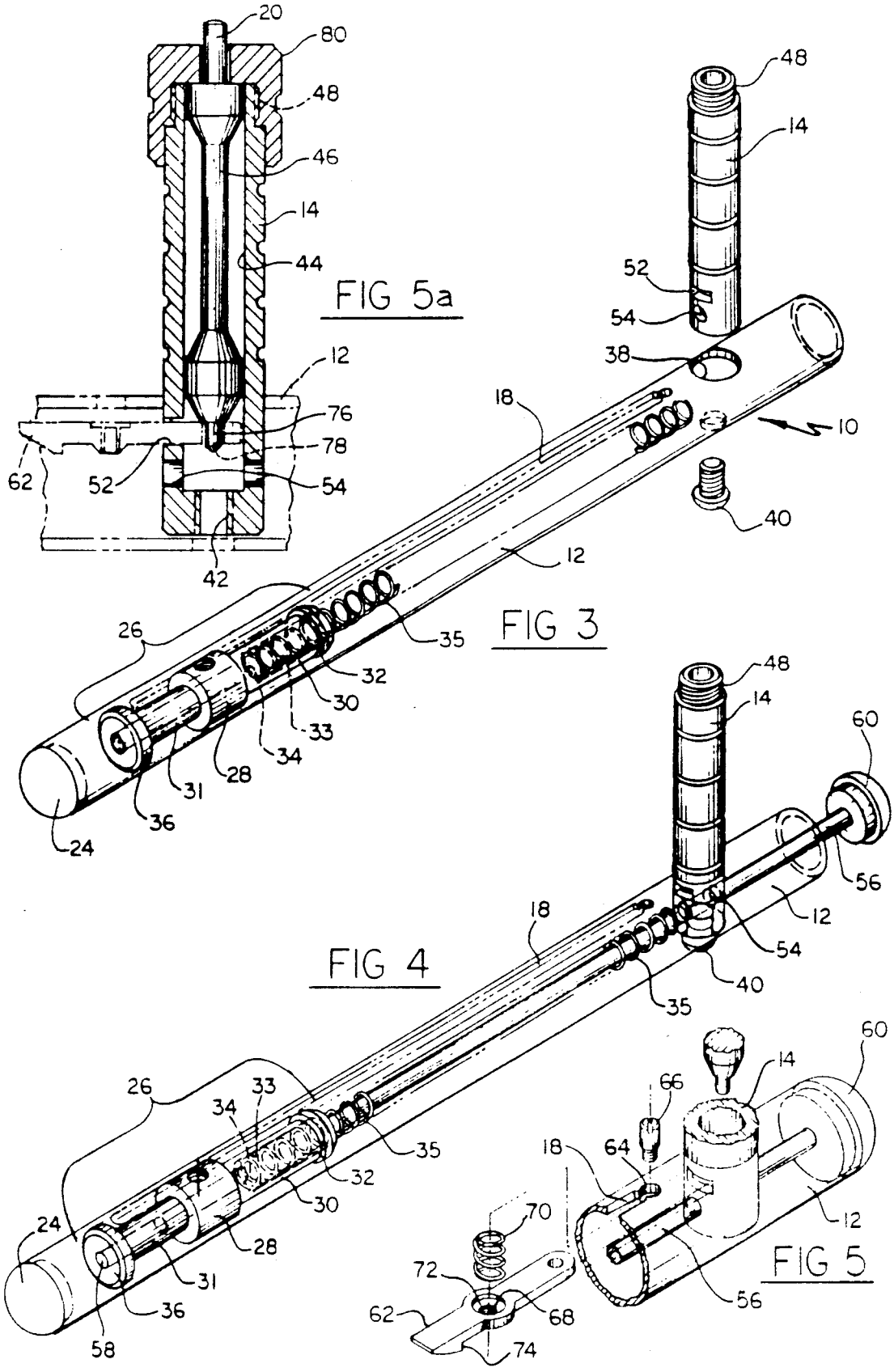
FIG. 3 is a perspective view showing the baton partially assembled.
FIG. 4 is a perspective view, similar to FIG. 3, showing the baton further assembled.
FIG. 5 is an exploded, perspective view showing the assembly of a spring catch.
FIG. 5a is a cross-sectional side view showing the spring catch of FIG. 5 assembled.

Referring now to FIGS. 3–7, the individual parts of the two-handle baton 10 and the assembly technique thereof will be shown in greater detail. In FIG. 3, the hollow shaft 12 is closed by a first cap 24 which may be attached to the end of shaft 12 by screw threads, for example. A sliding bolt mechanism 26 is then inserted into the hollow shaft 12 and permitted to bottom against the first cap 24. It will be seen that the bolt mechanism 26 comprises a central member 28 whose outer diameter is slightly smaller than the inner diameter of the hollow shaft 12 to permit the smooth sliding of the bolt mechanism 26 therein. In the preferred embodiment, this central member may be coated with a lubricating material. Extending from either side of the central member 28 are rods 30 and 31. The rod 30 extends to the right in FIG. 3 to terminate at an external shoulder 32 which is centrally bored at 33 to form an internal shoulder 34 at about the point where rod 30 extended from central member 28 (also see FIG. 7). A helically wound compression 35 spring is received within the bore 33 where it abuts shoulder 34 and is retained therein by a slight interference fit between the inner diameter of bore 33 and the outer diameter of spring 35. The left-hand rod 31 mounts a plunger 36 at its far end. The purpose of plunger 36 is to act as a dampening device within the hollow shaft 12 to control the speed and force with which the second handle 16 is moved from its closed to its open position. The reader will understand that the bolt mechanism 26 may be formed from one piece of corrosion resistant steel, for example, or the center member 28, rods 30 and 31 and plunger 36 may be made from separate pieces attached to one another by screws or screw threads, for example.

After the bolt mechanism 26 has been placed into shaft 12, the first handle 14 is attached to shaft 12 by insertion into an aperture 38 which is bored at a right angle to the hollow shaft 12. In the preferred embodiment, the outer diameter of aperture 38 is larger than the inner diameter of the hollow shaft 12. Handle 14 is inserted into the bored aperture 38 and retained therein by a fastener 40, such as a threaded screw. Other methods of attachment are possible such as a press fit or threading of shaft 14 and aperture 38.

As seen in FIG. 5*a*, handle 14 has been centrally drilled to form an aperture 42 and then tapped to receive the fastener 40. The aperture 42 is enlarged by a second aperture 44 to receive a rod 45 that includes the push button 20. The upper end of handle 14 is externally threaded at 48. The lower end of handle 14 is also provided with a slot 52 that communicates with the aperture 44 at a point near the end of rod 46. A pair of apertures 54 pass through the lower end of handle 14 below aperture 52 to complete the handle structure of handle 14.

Referring to FIG. 4, a slide rod 56 is inserted into the hollow shaft 12 and passed through the apertures 54 and handle 14. Slide rod 56 then extends through the inner diameter of compression spring 35 and through an aperture 58 which passes through the bolt mechanism 26 including rod 30, central member 28, rod 31 and plunger 36. After passing through plunger 36, the slide rod 56 is attached to the first cap 24 by threads, for example. Slide rod 56 is also threaded into a second cap 60 which may be drawn tightly against the shaft 12 as the rod 56 is threaded into cap 24.

After the slide rod 56 has been properly positioned, a spring catch 62 is inserted into slot 18, as seen in FIG. 5. Slot 18 is tapered at its end closest to handle 14 and communicates with an aperture 64 which receives a fastener 66. The fastener 66 may be a shaft whose lower end is threaded to threadably engage a threaded aperture 68 in spring catch 62. The lower end of fastener 66 receives a second compression spring 70 which is received within a counterbore 72 in aperture 68 in spring catch 62. The spring 70 may be retained within the counterbore 72 by a slight press fit or the counterbore 72 may be threaded to receive the pitch of the spring or a slightly resilient cap (not shown) may be inserted into counterbore 72 to receive the spring 70. Spring catch 62 is enlarged at its left-hand end to form a shoulder 74 with the farthest left-hand end of the catch 62 tapered to form a catch mechanism with shoulder 32.

It will be seen in FIG. 5*a* that the right-hand end of spring catch 62 fits into the slot 52 in handle 14 and extends under the rod 46. Once rod 46 is inserted into aperture 44, the spring catch 62 provides a stop for the rod 46 which has a small shouldered button 76 that extends down from the rod 46 to fit within an aperture 78 in spring catch 62. Slot 52 forms a fulcrum or pivot point for the spring catch 62 which is normally urged into a counterclockwise direction by the compression of spring 70. Rod 46 is retained in aperture 44 of handle 14 by a threaded cap 80, while rod 46 retains spring catch 62 in slot 52 by button 76 in aperture 78.

When the push button 20 is depressed, rod 46 causes the spring catch 62 to move in a clockwise direction for removing the shoulder 74 from engagement with shoulder 32. This permits the bolt mechanism 26 to slide down the hollow shaft 12 until the plunger 36 engages the first cap 24.

Figure 6:
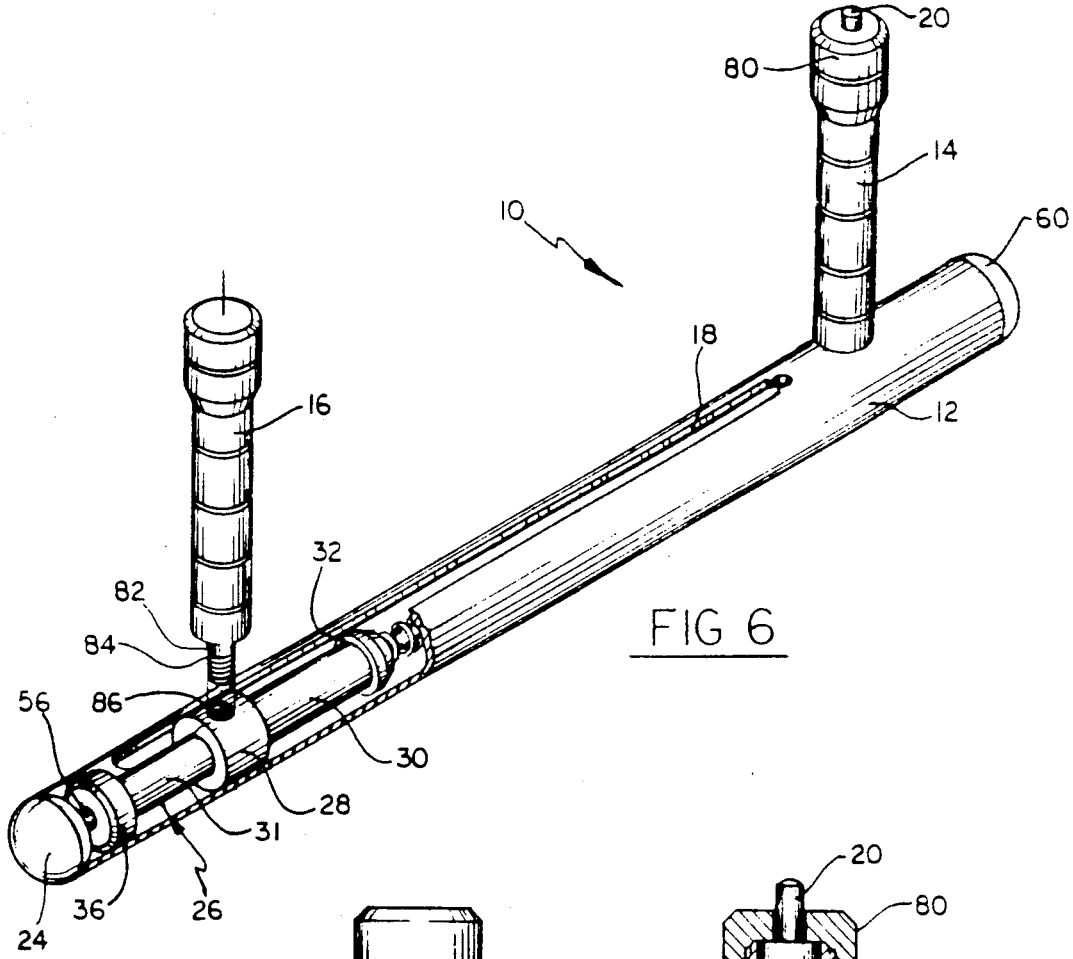
FIG. 6 is a perspective view, similar to FIG. 4, showing the assembly of the second handle.
Figure 7:
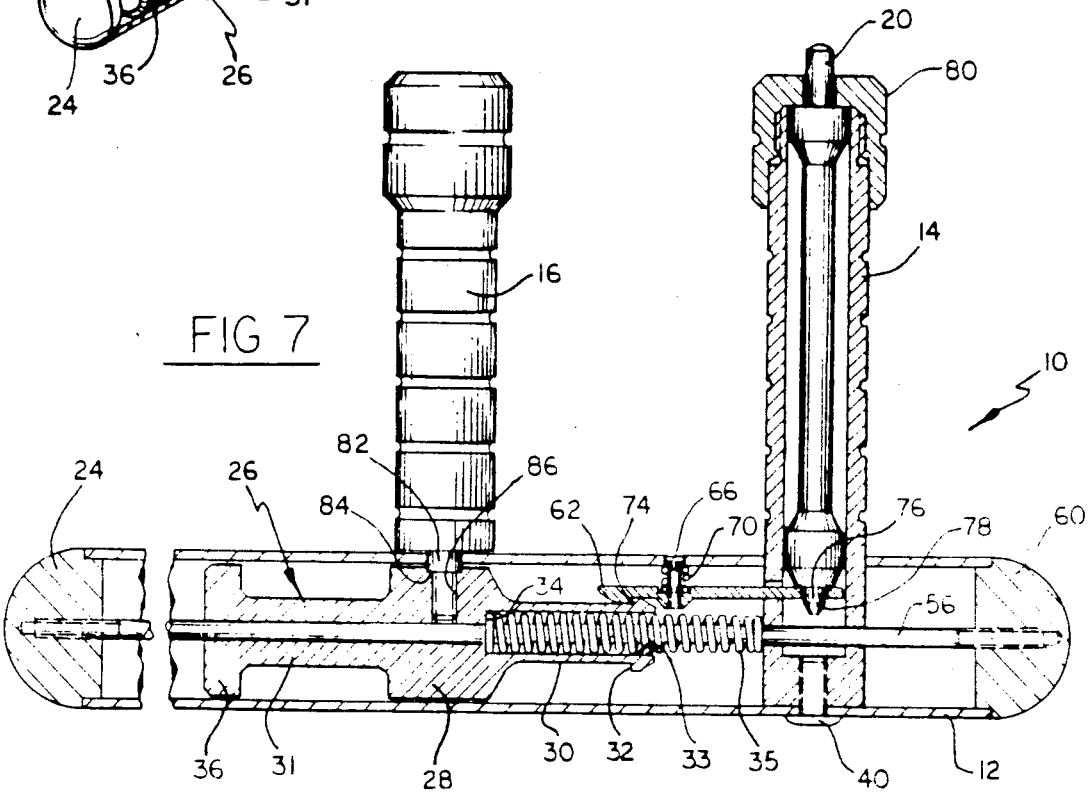
FIG. 7 is a side view in cross section showing the baton fully assembled.

As seen in FIG. 6, the second handle 16 is generally solid with a reduced shaft portion 82 extending from its lower end. The portion of shaft 82 closest to handle 16 is smooth to permit a sliding action within slot 18. The lowermost end of shaft 82 is reduced to form a shoulder 84 and threaded for insertion into a threaded aperture 86 in the central member 28 of bolt mechanism 26. This completes the assembly of the two-handle baton 10 as best seen in FIG. 7.

The fully assembled two-handled baton 10 may be used in several maneuvers as shown in FIGS. 1 and 8–11. FIG. 1 shows the two-handle baton in its normal position with the first handle 14 provided with an optional strap 22 and the push button release 20 for the spring loaded second handle 16. In the normal position of FIG. 1, the sliding handle 16 acts as a guard for the first handle 14 that is normally held by the user of the baton 10. By depressing the push button 20, the two-handle baton 10 opens with a loud snap sounding much like a shotgun bolt slamming into place. The baton of the present invention has been designed as a high tech weapon with finely machined parts which may be disassembled and cared for much as a firearm is.

Figure 8:
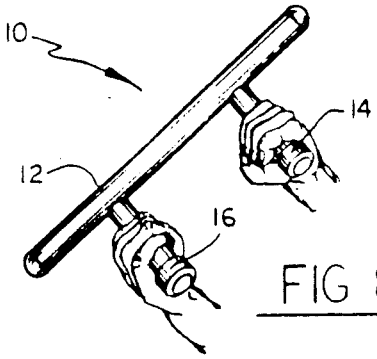
FIG. 8 is a perspective view showing the two-handle baton as it is used in a block maneuver.

The two-handle baton may be used for blocking maneuvers by depression of push button 20 to permit the second handle 16 to slide into its open position, as shown in FIG. 8. In this open position, both hands of the user grasp the handles 14 and 16 using the cylindrical shaft 12 of the baton 10 for a block. During such use, there is no problem with the baton sliding off the forearm of the user, as in the older, sigle-handle batons.

Figure 9:
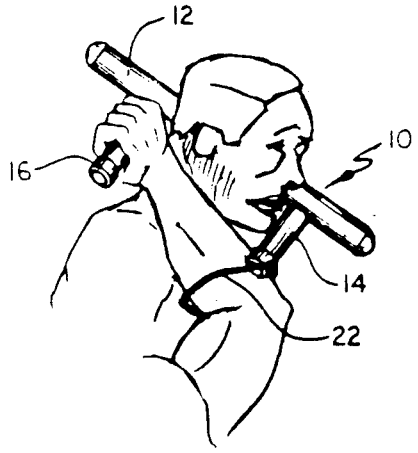
FIG. 9 is a perspective view showing the baton as it might be used in a one arm restraining hold.

In the open position, the baton 10 may also be used to place a restraining hold upon an individual utilizing the strap 22 around the forearm of the user, see FIG. 9. This permits the arresting officer to utilizing his free hand for cuffing the aggressor.

Figure 10:
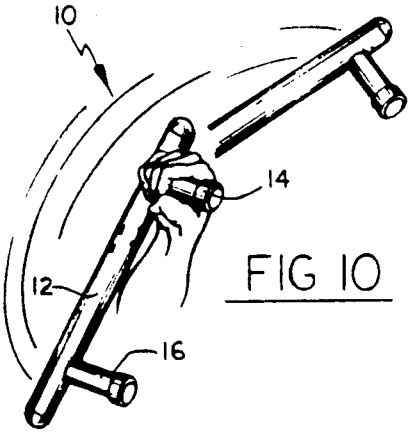
FIG. 10 shows the baton as it might be used in a spin or strike maneuver.

As seen in FIG. 10, the two-handle baton may be used for such maneuvers as spins or strikes. The two-handle baton 10 of the present invention is superior to the single-handed baton of the prior art since the second handle 16 will strike the user's forearm after a swing. The second handle thus permits the user to know precisely where the shaft 12 of baton 10 is after each swing. In this way, the user does not lose a sense of where his defensive weapon is at any instant.

Figure 11:
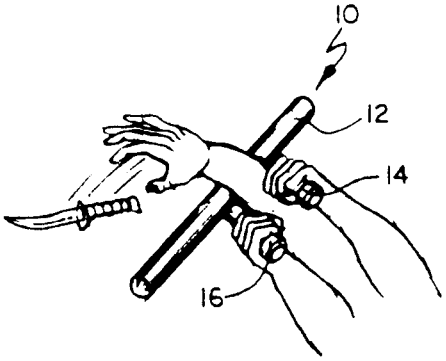
FIG. 11 shows the baton as it might be used in a locking and compression maneuver.

A new compression locking technique is illustrated in FIG. 11 wherein the user may grasp the second handle 16 to move it quickly toward the first, fixed handle 14. It will be recalled that the spring catch 62 is provided with a tapered surface which permits the compression spring 34 to be ratcheted under the spring catch 62 for quick and easy closure of handle 16 against the forearm of an attacker. The ratcheting mechanism of spring catch 62 will then prevent the opening of the space between handles 14 and 16.

Figure 12:
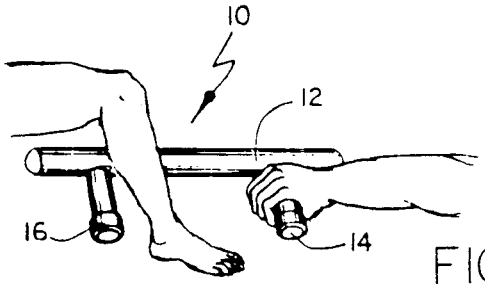
FIG. 12 shows the baton as it might be used in a sweep or hook maneuver

Still a further technique for using the two-handle baton 10 of the present invention is shown in FIG. 12. Here, a hooking maneuver may be accomplished by gripping the first handle 14 and utilizing the second handle 16 to hook an attacker's leg, for example. The two-handle baton 10 of the present invention is superior to previous batons since previous batons require the user to reverse his grip and use the handle to hook the aggressor. Should the aggressor grab the handle of the prior art baton, the aggressor would have a better grip than the user and could disarm the user of the baton.

The reader will understand that the two-handle baton 10 of the present invention may be constructed from various materials and used in several configurations. Further, the spring and latch mechanism and particular design of the baton may vary within the teachings of the present invention. Accordingly, the present invention should be limited only by the appended claims.

I claim:

1. A baton for self-protection and police work, comprising:

a cylindrical shaft having a longitudinal slot therein;

a first handle firmly mounted upon said cylindrical shaft for gripping by a user's hand extending from one side of said cylindrical shaft at an angle thereto;

a second handle slidably mounted without said slot in said cylindrical shaft for gripping by a user's hand extending from the same one side of said cylindrical shaft as said first handle, at an angle to said shaft and parallel to said first handle; and a spring for urging said second handle slidably away from said first handle.

2. The baton of claim 1, additionally comprising:

said first and second handles mounted upon one end of said cylindrical shaft, wherein said second handle acts as a guard for said first handle.

3. The baton of claim 1, wherein:

said first and second handles are mounted at right angles to said cylindrical shaft.

4. The baton of claim 1, additionally comprising:

said first handle having a spring release mechanism therein;

a spring catch extending from said first handle for engaging and restraining said spring; and said spring release mechanism causing said spring catch to release said spring to permit said second handle to slide within said cylindrical shaft.

5. A baton for self-protection and police work, comprising:

a hollow shaft;

a first handle mounted upon said shaft at a right angle thereto;

a second handle slidably mounted within said shaft at a right angle thereto and parallel to said first handle;

a spring mounted within said hollow shaft for urging said second handle slidably from said first handle; and a spring release mechanism mounted within said first handle for restraining said spring and said second handle.

6. The baton of claim 5, wherein:

said second handle is restrained by said spring release mechanism at the same end of said shaft as said first handle wherein said second handle acts as a guard for said first handle.

7. The baton of claim 6, additionally comprising:

said hollow shaft having a slot therein which receives said release mechanism at one end of said slot and which limits the slidable travel of said second handle to the opposite end of said slot.

8. The baton of claim 7, wherein said release mechanism additionally comprises:

said first handle formed from a hollow tube;

a push botton rod mounted within said slot, extending into said hollow tube to engage said push button rod at one rod, and engaging said spring at its opposite end, and a second spring for urging said spring catch into engagement with said first mentioned spring.

* * * * *